United States Patent [19]

Arthur

[11] 4,311,885

[45] Jan. 19, 1982

[54] SNAP ACTION SLIDE SWITCH

[75] Inventor: Ronald H. Arthur, Lauderhill, Fla.

[73] Assignee: AMF Incorporated, White Plains, N.Y.

[21] Appl. No.: 181,555

[22] Filed: Aug. 27, 1980

[51] Int. Cl.[3] ..... H01H 15/02

[52] U.S. Cl. ..... 200/16 C; 200/16 D

[58] Field of Search ..... 200/16 R, 16 B, 16 C, 200/16 D, 16 F, 67 G, 68, 69, 76, 77, 78, 291

[56] References Cited

U.S. PATENT DOCUMENTS

| | | | |
|---|---|---|---|
| 2,966,560 | 12/1960 | Gluck | 200/16 C |
| 3,501,599 | 3/1970 | Horecky | 200/16 D |
| 3,636,286 | 1/1972 | Hults | 200/69 |
| 3,643,046 | 2/1972 | Zdanys et al. | 200/68 X |
| 3,674,953 | 7/1972 | Brevick | 200/16 D X |
| 3,843,852 | 10/1974 | Lockard | 200/16 D |
| 3,912,887 | 10/1975 | Gratz et al. | 200/16 D |
| 3,947,391 | 3/1976 | Lutzenberger | 200/16 F |
| 3,963,884 | 6/1976 | Pollock | 200/16 D |
| 4,128,745 | 12/1978 | Marsilio et al. | 200/16 C |
| 4,180,712 | 12/1979 | Lutzenberger et al. | 200/16 F |

*Primary Examiner*—James R. Scott

*Attorney, Agent, or Firm*—George W. Price; Lawrence Hager

[57] ABSTRACT

A snap action slide switch concludes an improved spring detent means including resilient spring means on the contact carrier which stores energy and releases the energy at such position of the contact carrier to enhance rapid movement of the contact carrier to its different switching position.

17 Claims, 4 Drawing Figures

SNAP ACTION SLIDE SWITCH

BACKGROUND OF THE INVENTION

This invention relates to electrical switches that are useful for switching electrical power and for switching electrical signals at very low energy levels. In many types of switching requirements the contacts must open and close with a positive snap action in which the snap motion is independent of the speed at which the switch actuator is moved by its operator. Further, these snap type switches must be constructed so that the moving contact will come to rest in the fully ON or fully OFF positions, and not at some intermediate position. Further, when the actuator is released by the operator selected contacts must remain in the ON or OFF position to which they were last moved by the operator.

In the past, the above desired properties were provided primarily by what are known as precision snap switches. These switches often are expensive to manufacture. The snap action slide switch of this invention achieves the above described operating objectives and is relatively simple and inexpensive to manufacture.

BRIEF DESCRIPTION OF THE DRAWINGS

The invention will be described by referring to the accompanying drawings wherein.

DESCRIPTION OF PREFERRED EMBODIMENT

Figure 1:
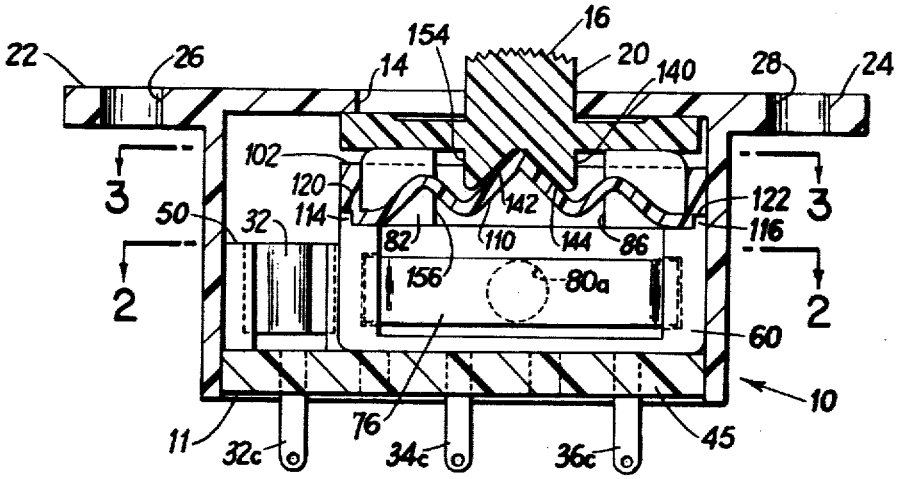
FIG. 1 is a side view showing various internal features of the switch of this invention.

The switch is comprised of a box-like molded plastic housing 10 that has an open bottom 11. The top of the housing is closed except for an elongated aperture 14 that permits the handle 16 of an actuator member 20 to extend therethrough. Actuator member 20 is slidable back and forth between respective extreme positions wherein the opposite end surfaces of handle 16 are in contact with opposite ends of aperture 14. Mounting tabs 22 and 24 having respective mounting holes 26, 28 therein extend outwardly from opposite sides of the top of housing 10.

Figure 2:
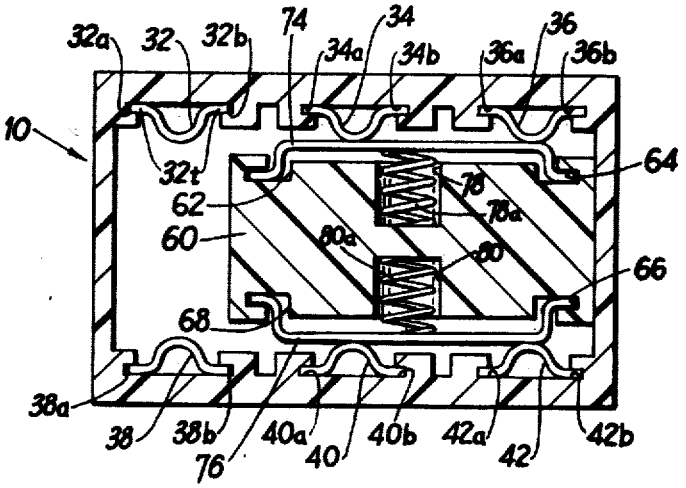
FIG. 2 is a view taken substantially at section 2—2 of FIG. 1 and shows in detail the contacts of the switch.

As seen in FIGS. 1 and 2, the bottom portions of opposite interior side walls of housing 10 have integrally molded therein six pairs of facing parallel slots **32*a*, 32*b*–42*a*, 42*b* that are adapted to slidingly receive respective stationary contacts 32, 34, 36, 38, 40 and 42. The pairs of facing slots extend to the open bottom of housing 10** and terminate somewhere around the mid region on the side walls.

The stationary contacts are identical and have terminals **32*c*–42*c* that extend through a rigid insulating terminal board 48. The top portions of the stationary contacts are broad and are shaped to form edge tabs, such as 32*t*, FIG. 2, that are slidably engaged in a pair of facing slots 32*a*, 32*b* so as to be firmly retained in housing 10. The slots terminate at their top ends at a thickened portion 50 of the housing, thus blocking further insertion of the contacts. The central portion of each contact, between tabs 32*t*** for example, bows outwardly to be engagable by the sliding contact, as will be explained. As is well understood in the art, the portions of the stationary contacts between the bottom ends of the terminals and the broad top portions may be bent and shaped in any manner to achieve desired spacings between adjacent contacts, and between parallel rows of the terminals.

Terminal mounting board 48 is provided on opposite side edges with protruding tabs that fit into complementarily shaped apertures at the bottoms of the side walls of housing 10, thereby to secure the terminal board to the housing. The plastic side walls are sufficiently flexible to permit easy assembly and disassembly of the terminal board and housing. Other suitable fastening means may be provided if desired. For example, the interiors of the flexible side walls of housing 10 may be provided with detents or barbs that releasably engage straight edges of the terminal board so as to hold the board in the housing.

A molded plastic contact carrier 60 is positioned between the side walls of hollow rectangularly shaped housing 10 and is adapted to slide on the top surface of terminal mounting board 48. As seen in FIGS. 1 and 2, the lower portions of the opposite side walls of contact carrier 60 have respective pairs of facing slots 62, 64 and 66, 68 molded therein. Elongated, rectangularly shaped sliding contacts 74 and 76 have their ends fashioned to form tabs that are insertable into the slots 62, 64 and 66, 68. Helical springs 78 and 80 are received within the centrally positioned apertures **78*a* and 80*a* and spring bias the respective sliding contacts 74 and 76** outwardly into sliding contact with selected ones of the stationary contacts.

Figure 3:
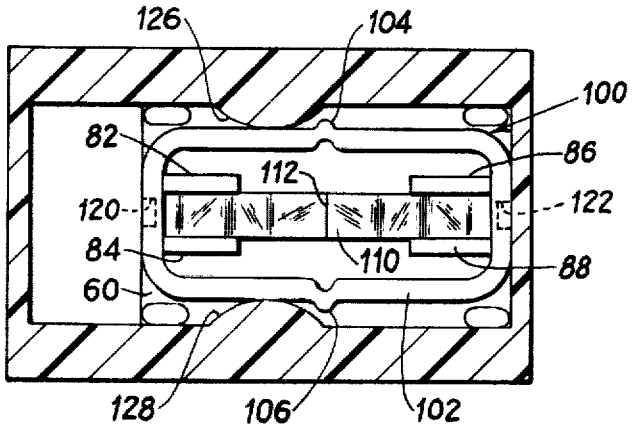
FIG. 3 is a view taken substantially at section 3—3 of FIG. 1 and shows in detail the spring detent means on the contact carrier and their relationship with the detent means on the housing.

As seen in FIGS. 1 and 3, two pairs of molded posts or fins 82, 84 and 86, 88 are located near opposite ends of contact carrier 60 and extend upwardly from the top surface of the contact carrier. The tops of posts 82, 84, 86 and 88 are in sliding contact with the bottom surface of actuator 20. Posts 82, 84, 86 and 88 thus properly position contact carrier 60 within housing 10 and prevent the contact carrier from becoming cocked during its sliding movement.

A molded plastic spring detent member 100 also is placed on top of contact carrier 60. Spring detent member 100 desirably is molded as an integral unit and includes a closed loop or band of generally rectangular shape that forms a base detenting member 102. Two outwardly projecting detents 104 and 106 are located at the mid regions on the opposite long side legs of base detenting member 102. A shaped central web or strap 110 has a central apex 112 that extends between the two ends of base member 102 and serves as a spring member, as will be explained below. As seen in FIGS. 1 and 3, small rectangularly shaped keys 114 and 116 are integrally molded at the center on each end of the top surface of contact carrier 60. Respective rectangular notches 120, 122 in the bottom center at each end of base detenting member 102 fit over the keys 114 and 116 and aid in positioning spring detent member 100. Posts 82, 84, 86 and 88 also are shaped and positioned to receive the ends of center web 110 and the inside of the end legs of base detent 102 and maintain it in its desired fixed position on contact carrier 60.

Each of the opposite interior side walls of housing 10 have vertically extending rounded detents 126, 128 molded therein and projecting inwardly toward the center of the housing. The detents 104 and 106 on the side legs of base detenting member 102 are positioned at a height to register with the respective detents 126 and 128 on housing 10. The thin plastic side legs of base detent member 102 are flexible and spring-like and will yield to permit their detents 104 and 106 to pass over detents 126 and 128 on the interior side walls of housing 10.

Figure 4:
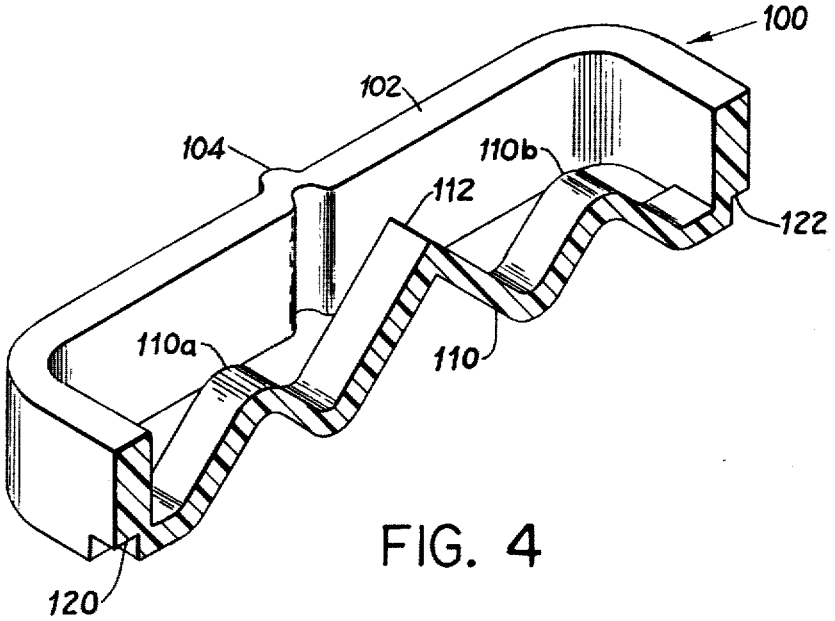
FIG. 4 is a perspective view, in section, showing the detent spring means of this invention.

The bottom surface of switch actuator 20, FIG. 1, has a V-shaped notch member 140 with two inclined cam surfaces 142 and 144 integrally molded thereon. V-shaped notch member 140 is wide enough to intercept a pair of the posts 82, 84 or 86, 88, as will be explained. The apex 112 of the center web or strap 119 of spring detent member 100 is adapted to fit in the base of the V-shaped notch between the inclined cam surfaces 142 and 144. Web 110 is of thin plastic material and is flexible and spring-like. As best seen in FIG. 4, web 110 has two curved portions 110*a* and 110*b* for storing energy therein when the apex 112 is pushed downwardly. Although not presently desired, web 110 may be molded independently of detent base member 102.

In operation, assuming that the component parts are in the positions illustrated in FIG. 1, it is seen that the apex 112 of center web 110 of spring detent member 100 is centered in the V-shaped notch member 140. Further, as seen in FIG. 3, detents 104 and 106 on the side legs of the base detent member 102 are on the right side of housing detents 126 and 128. Actuator 20 is at its extreme right position. With these assumed positions, sliding contacts 74 and 76 establish electrical continuity between the center terminals and the respective terminals on the right end of the switch. To change the switching condition of the switch the operator pushes actuator 20 to the left. As the actuator first begins to move the apex 112 on the center web or strap 110 begins to move down the inclined cam surface 144, causing web 110 to begin to flex downwardly and store energy. During the initial movement of actuator 20, the contact carrier 60 will not move because of the frictional forces between the stationary and sliding contacts and the resistive forces produced as a result of detents 104 and 106 on spring detent member 100 interfering with projecting housing detents 126 and 128. As actuator 20 continues to move to the left web 110 will be deflected more as apex 112 slides further down cam surface 144. This will continue until the left edge 154 of the V-shaped notch member 140 contacts the right edges 156 of posts 82 and 84 on the top of contact carrier 60. Firm contact now having been made, contact carrier 60 will move to the left as actuator 20 continues to move to the left. Base detent member 102 now moves relative to housing 10 and the detents 104 and 106 now begin to move up the right sides of housing detents 126 and 128. The flexible side legs of base detent 102 begin to flex inwardly, thus storing energy. The apex 112 of flexible center web 110 still is somewhere on the inclined cam surface 144 of V-shaped notch member 140 as actuator 20 and contact carrier 60 first begin to move together. Thus, web 110 continues to store energy at this time.

It is to be noted that the notches 120 and 122, FIGS. 3 and 4, on the undersides of the end legs of base detent means 102 are seated on the respective protruding keys 114 and 116 on contact carrier 60, thus preventing the end legs from flexing. This fixes the ends of web 110 and assures that the energy is stored in the flexed web 110 rather than the end legs.

As detents 104 and 106 on base detent member 102 continue to move up the curved surface of housing detents 126 and 128 the side legs of the base member 102 flex more and store additional energy. At some point in the movement of contact carrier 60 the contact angle between detents 104, 106 and housing detents 126 and 128 reaches a predetermined low angle at which the resistive force therebetween decreases to a predetermined magnitude. At this point the energy stored in flexed web 110 is greater than the combined resistive forces between the contacts and between the detents 104, 106 and 126, 128. When this condition is reached the contact carrier 60 will accelerate and snap to the left at a greater speed than the moving actuator 20. Detents 104 and 106 pass over the center high points of housing detents (or cams) 126 and 128 (if they have not already arrived there) and move down the opposite sides thereof as stored energy in the side legs of base member 102 is released. Similarly, the apex 112 of center web 110 slides up the inclined cam surface 144 to the base, or high point, of V-shaped notch member 140 and releases its stored energy as it unflexes.

In the manner described, contact carrier 60 snaps to its extreme left position at which its left end is in substantial contact with the left end of housing 10 and/or the left side of actuator handle 16 is in contact with the left edge of aperture 14. The snapping action of contact carrier 60 carries actuator 20 with it since there is but small frictional force between the actuator and housing 10. When actuator 10 and contact carrier 60 come to rest the apex 112 of web 110 is centered in the V-shaped notch member 140 in the relationship illustrated in FIG. 1. Further, detents 104 and 106 of base detent member 102 are now on the far left sides of housing detents 126 and 128. This positions contact carrier 60 so that sliding contacts 74 and 76 are bridging the center and left-most stationary contacts. Contact carrier 60 will remain in this position and it will require a substantial force to move it back to the right in view of the combined resistive forces provided by the stationary and sliding contacts, the detents 104, 106 and 126, 128 and web 110 in engagement with cam surfaces 142 and 144 of V-shaped notch member 140. Consequently, the switch is "tease proof" in that it will take more than a casual, small, force to move contact carrier 60 away from the extreme position it was last switched to.

Although the switch described herein is a double pole, double throw switch, the principles of the invention are equally applicable to other switch forms.

In its broader aspects, this invention is not limited to the specific embodiment illustrated and described. Various changes and modifications may be made without departing from the inventive principles herein disclosed.

I claim:

1. A snap action slide switch comprising a hollow box-like housing having an open bottom and a substantially closed top, an elongated aperture in said top, a switch actuator within said housing proximate said top and accessible through said aperture for sliding said actuator back and forth within said housing, a plurality of spaced stationary contacts mounted within said housing, a translatable contact carrier within said housing between said actuator and the bottom of the housing, means for slidingly supporting said contact carrier within said housing, at least one sliding contact on said contact carrier and translatable therewith, said sliding contact being constructed and arranged to selectively make and break contact with said stationary contacts when the contact carrier is translated between first and second positions, detent means on at least one interior side wall of said housing, cam means on the interior surface of said actuator and facing said contact carrier, spring detent means carried on said contact carrier and having a first spring means engagable with said cam means and a second detent means engagable with said housing detent means, means associated with said second detent means for storing energy during a detenting operation of said second detent means with said housing detent means, means permitting a predetermined limited translation of said actuator relative to said contact carrier before the actuator engages the contact carrier to cause both to move together, said first spring means being flexed by said cam means as the actuator and contact carrier move relative each other from a first relative position, thereby storing energy in the spring means, said housing detent means and said second detent means moving relative to each other as the contact carrier moves with said actuator, thereby storing energy in said energy storage means associated with the second detent means during a predetermined limit of travel of the two detenting means relative to each other, said last named energy storage means releasing energy when said predetermined limit of travel is passed, the first spring means being constructed and arranged to store sufficient energy to move the contact carrier independently of the motion of the actuator when the second detent means reaches a given location relative to the housing detent means.

2. The combination claimed in claim 1 wherein said spring detent means comprises a base detent means in the shape of a closed loop or band having long flexible opposite side legs and shorter opposite end legs, said second detent means comprising first and second protrusion extending outwardly on respective ones of said side legs, said housing detent means comprising first and second protrusions extending inwardly from opposite interior side walls of the housing.

3. The combination claimed in claim 2 wherein said base detent means includes a central flexible web extending between said opposite end legs and having means intermediate its ends for engaging the cam means on the actuator, thereby serving as said first spring means.

4. The combination claimed in claim 3 where the center web has an apex intermediate its two ends for operatively engaging said cam means.

5. The combination claimed in claim 3 including means on the top of said contact carrier for removably attaching the spring detent means to the contact carrier.

6. The combination claimed in claim 5 where said means for removably attaching the spring detent means to the contact carrier includes keys protruding from the top surface at opposite ends of the contact carrier or from the bottom surface at the opposite end legs of the spring detent means and complementary mating notches in the other one of the surfaces for substantially fixing the end legs and thereby substantially preventing them from flexing when the center web is flexed.

7. The combination claimed in claim 6 and further including, a plurality of spaced posts extending upwardly from the top surface of the contact carrier and adapted to slidingly engage the actuator to prevent the contact carrier from becoming cocked during its sliding movement.

8. The combination claimed in claim 7 wherein said posts are located to aid in positioning said base of the spring detent means.

9. In a slide switch having at least one sliding contact that is translatable relative to stationary contacts that are fixed in a hollow, box-like housing, an improved snap action feature that causes the sliding contact to snap to a different position independently of the movement of the switch actuator after the actuator has moved the sliding contact some given distance less than the total distance to its second switching position, said improvement comprising a contact carrier slidingly positioned within said housing and carrying said sliding contact between different switching positions, a switch actuator having at least a portion thereof within said housing and accessible from outside the housing, V-shaped cam means fixed to the interior portion of said actuator at a location near said contact carrier, the bottom of the V-shape being farthest from the contact carrier, spring detent means fixed to and carried on said contact carrier, said spring detent means having a flexible spring means operatively engagable with the bottom of the V-shape of the cam means and additionally having first detent means adjacent the housing interior surface, second detent means on said housing interior surface and engagable with said first detent means when the contact carrier is moved from one if its switching positions, at least one of said detent means storing energy during a first portion of the relative movement therebetween and releasing said stored energy during the remainder of the relative movement therebetween, the resistive force arising from engagement of the two detenting means changing from a maximum when they first engage to some smaller value when the detenting means have traveled a given distance relative to each other, means permitting relative movement through a limited distance between the actuator and contact carrier when the actuator is first moved from a switching position toward a different one, said actuator and contact carrier moving together after said limited distance is exceeded, said spring means on the spring detent moving up the sides of the V-shaped cam means and thereby being flexed during relative motion between the actuator and contact carrier away from a switching position, the spring means retaining energy stored therein when the actuator and contact carrier move together, said spring means being constructed and arranged to store sufficient energy to cause the contact carrier to snap to its different switching position when the resistive force between the two detent means decreases to said smaller value after the detenting means have moved said given relative distance, said spring means moving the actuator so that the spring means returns to the bottom of the V-shape cam means when the contact carrier arrives at its different switching position.

10. The combination claimed in claim 9 wherein said spring detent means comprises a base detent means in the shape of a closed loop or band having long flexible opposite side legs and shorter opposite end legs, said second detent means comprising first and second protrusion extending outwardly on respective ones of said side legs, said housing detent means comprising first and second protrusions extending inwardly from opposite interior side walls of the housing.

11. The combination claimed in claim 10 wherein said base detent means includes a central flexible web extending between said opposite end legs and having means intermediate its ends for engaging the cam means on the actuator, thereby serving as said spring means.

12. The combination claimed in claim 10 wherein the center web has an apex intermediate its two ends for operatively engaging the bottom of said V-shaped cam means, said apex on the web being flexed by the inclined surfaces of the V-shaped cam means during relative motion between the actuator and contact carrier.

13. The combination claimed in claim 12 including means on the top of said contact carrier for removably attaching the spring detent means to the contact carrier.

14. The combination claimed in claim 13 where said means for removably attaching the spring detent means to the contact carrier includes keys protruding from the top surface at opposite ends of the contact carrier or from the bottom surfaces at the opposite end legs of the spring detent means and complementary mating notches in the other one of the surfaces for substantially fixing the end legs and substantially preventing them from flexing when the center web is flexed.

15. The combination claimed in claim 14 and further including, a plurality of spaced posts extending upwardly from the top surface of the contact carrier and adapted to engage the actuator for stablizing the contact carrier during its translation.

16. The combination claimed in claim 15 wherein said posts are located to aid in positioning said base of the spring detent means.

17. In a slide switch having at least one sliding contact that is translatable relative to stationary contacts that are fixed in a housing having a hollow interior, an improved snap action feature that causes the sliding contact to snap to a different switching positions independently of the movement of the switch actuator after the actuator has moved the sliding contact some given distance less than the total distance between two switching positions, said improvement comprising a contact carrier slidingly positioned within said housing and carrying said sliding contact between different switching positions, a switch actuator having at least a portion thereof within said housing and accessible from outside the housing, V-shaped cam means on the actuator at a location near said contact carrier, the bottom or apex of the V-shape being farthest from the contact carrier, first detent means fixed relative to said housing, spring detent means carried on said contact carrier and comprising a base detent means in the shape of a closed loop or band having flexible opposite side legs and opposite end legs, second detent means comprising at least one protrusion extending outwardly from a side leg of said band and engagable with the first detent means, said spring detent means further including a central flexible web or strap extending between said opposite end legs and having an apex that is engagable with the V-shaped cam means on the actuator, means permitting a predetermined limited translation of the actuator relative to the contact carrier before the actuator engages the contact carrier to cause both to move together, said web on the spring detent means being flexed by said cam means as the actuator and contact carrier move relative to each other from a first relative position in which the apexes of the two are in registration, thereby storing energy in the web, said first and second detent means moving relative to each other and engaging each other when the contact carrier moves with said actuator but not during said predetermined limited translation of the actuator relative to the contact carrier, said side leg having the second detent means thereon storing energy during a predetermined limit of travel of the two detenting means relative to each other, said side leg releasing its stored energy when said predetermined limit of travel is exceeded, said web storing sufficient energy to move the contact carrier independently of the motion of the actuator when the second detent means reaches a given location relative to the first detent means, said web moving the actuator to bring the two apexes into registration when the contact carrier has been snapped to its different switching position.

* * * * *